US008562493B2

(12) United States Patent
Haven (Haviv)

(10) Patent No.: US 8,562,493 B2
(45) Date of Patent: Oct. 22, 2013

(54) EXERCISE AND TRAINING APPARATUS

(76) Inventor: Joseph Haven (Haviv), Tiberias (IL)

( * ) Notice: Subject to any disclaimer, the term of this patent is extended or adjusted under 35 U.S.C. 154(b) by 428 days.

(21) Appl. No.: 12/924,997

(22) Filed: Oct. 12, 2010

(65) Prior Publication Data

US 2011/0118093 A1 May 19, 2011

Related U.S. Application Data

(63) Continuation-in-part of application No. 11/056,658, filed on Feb. 11, 2005, now abandoned.

(51) Int. Cl.
*A63B 21/008* (2006.01)
*A63B 21/04* (2006.01)

(52) U.S. Cl.
USPC ..... 482/112; 482/130

(58) Field of Classification Search
USPC ..... 482/55–56, 72–73, 121, 111–113, 482/129–130
See application file for complete search history.

(56) References Cited

U.S. PATENT DOCUMENTS

| | | | | | |
|---|---|---|---|---|---|
| 4,602,780 | A | * | 7/1986 | Gall | 482/73 |
| 4,627,610 | A | * | 12/1986 | Ishida et al. | 482/73 |
| 4,830,363 | A | | 5/1989 | Kennedy | |
| 4,867,447 | A | * | 9/1989 | Johnson | 482/73 |
| 5,158,513 | A | | 10/1992 | Reeves | |
| 5,393,280 | A | * | 2/1995 | Haviv | 482/56 |

* cited by examiner

*Primary Examiner* — Fenn Mathew

(57) ABSTRACT

The exercise and training apparatus includes:
A base disposed on a supporting surface for the apparatus.
An upper body support arrangement secured to the base frame in a manner that allows several positions from generally horizontal position to a generally vertical position.
A lower body support arrangement secured to the base frame adjacent to the upper body support having a generally horizontal position.
A head support secured to the upper body support arrangement.
A pair of hand levers attached to the upper body support one on each side in a manner that allows the user's hands to move the levers in plural directions.
A lever secured to the lower body support arrangement capable of receiving the user's legs in a manner that allows the user to move the lever in plural directions.
An adjustable resistance device secured to each lever in order to provide resistance to movement of the lever.

5 Claims, 3 Drawing Sheets

EXERCISE AND TRAINING APPARATUS

This application is a continuation-in-part of application 11/056,658 filed Feb. 11, 2005 now abandoned.

BACKGROUND OF THE INVENTION

The present invention relates to exercise apparatus and more particularly to improved exercise and training apparatus which can provide a cardio and endurance workout by simulating the movement of swimming dolphins.

Experts in the field of fitness and exercise are in agreement that actually performing exercises is the most beneficial way to promote health and well being. One of the most effective methods of exercising is swimming as it provides an effective cardiovascular regimen and is a very low impact exercise.

Exercise and training apparatus are described in prior art as represented in U.S. Pat. No. 5,158,513 issued on October 1992 to Michael P. Reeves and U.S. Pat. No. 4,830,363 issued on May 1989 Robert J. Kennedy and U.S. Pat. No. 5,393,280 issued on February 1995 to Joseph Haviv and various U.S. patent referred to in these patents. The prior art exercise and training apparatus enables the users to approximate the kicking movement of the user's legs however they fail to provide an arrangement which would enable the users to move both legs in unison in several directions such as up and down, side to side and in a diagonal directions. Multiple body positions such as upright sitting position and several incline positions and flat laying position are also limited.

The present invention object is to provide an improved exercise and training apparatus which enables the users lower body to simulate the movement of a swimming dolphin tail with both legs in unison.

Another object of the present invention is to provide an arrangement which allows movement of the users legs in unison in plural directions.

Another object of the present invention is to provide an arrangement which Allows the user to exercise in several body positions.

Another object of the present invention is to provide means to adjust the resistance of the legs and arms levers.

SUMMARY OF THE INVENTION

In accordance with the present invention there is provided an exercise and training apparatus.

An object of the present invention is to provide an improved exercise and training apparatus.

Another object of the present invention is to provide an improved exercise and training apparatus enabling the users lower body to simulate the movement of a swimming dolphin tail with both legs in unison.

Another object of the present invention is to provide an arrangement which allows the user to exercise in several body positions.

Another object of the present invention is to provide means to adjust the resistance of the legs and arms levers.

Another object of the present invention is to provide an arrangement which allows the users to exercise by moving arms and legs simultaneously or separately.

Another object of the present invention is to provide an arrangement which allows the users to adjust the length of legs lever and the length of the arm levers in order to accommodate different users.

BRIEF DESCRIPTION OF THE DRAWINGS

These and other advantages of the present invention will become more apparent upon reading the following detailed description and upon referring to the accompanying drawing in which.

PARTS AND NUMERALS

Figure 1:
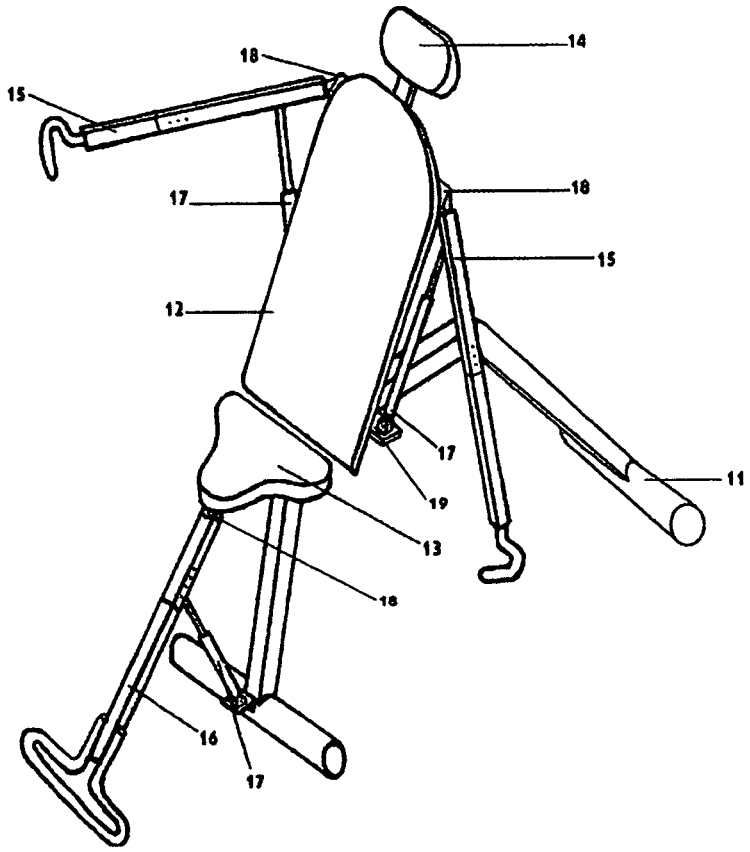
FIG. 1. is a perspective view of an exercise and training apparatus in accordance with the present invention.
Figure 2:
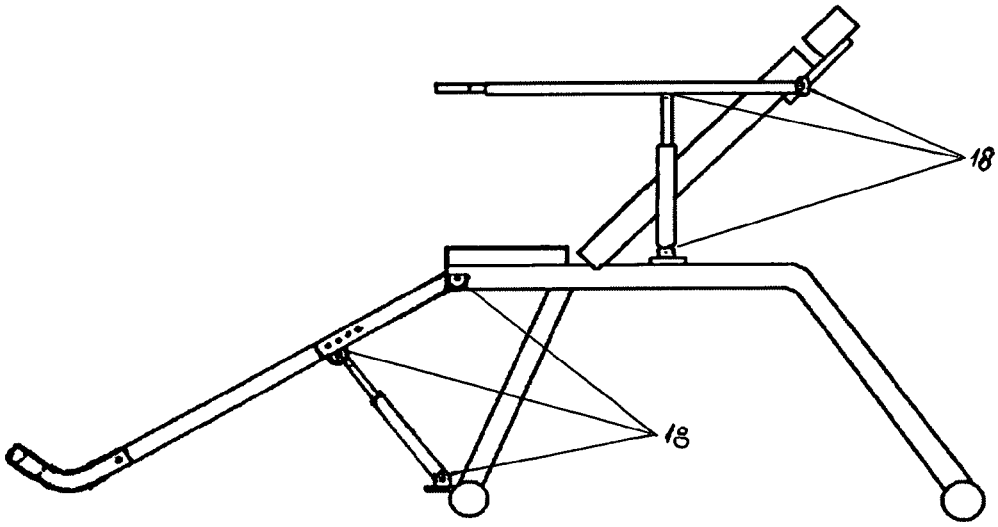
FIG. 2. is a side view of an exercise and training apparatus in an incline position. in accordance with the present invention.
Figure 3:
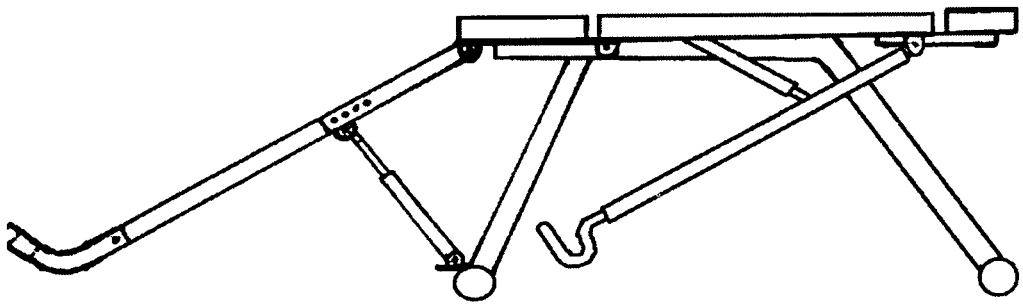
FIG. 3. is a side view of an exercise and training apparatus in a horizontal incline position in accordance with the present invention.

11. Base.
12. Upper body support.
13. Lower body support.
14. Head support.
15. Arm lever.
16. Legs lever.
17. Resistance means.
18. Universal flexible joint
19. Connection means.

DETAILED DESCRIPTION OF THE INVENTION

In the following description similar features and parts in the drawings were given similar numerals.

Referring to FIG. 1. there is illustrated an exercise and training apparatus in accordance with the present invention.

The apparatus comprises a base means (11) disposed on a supporting surface.

An upper body support (12) attached to base means (11) in a manner that allows the positioning of the upper body support (12) in several positions ranging from generally horizontal position to generally vertical position.

A lower body support (13) attached to base means (11) adjacent to upper body support (12) aft end in a manner that allows adjustment of the distance between the lower body support (13) and the upper body support (12).

A head support (14) attached to upper body support (12) at the fore end in a manner that allows adjustment of the distance between the head support (14) and the upper body support (12).

A flexible universal joint (18) is attached to each side of the upper body support (12) at the generally upper section.

A flexible universal joint (18) is attached to the lower body support (13). Two arm levers (15) are attached to the two upper flexible universal joints (18) in a manner that allows movement of the arm levers (15) in several planes.

A legs lever (16) is attached to the lower flexible universal joint (18) in a manner that allows movement of the legs lever (16) in several planes.

Resistance means (17) is provided for each arm lever (15).

Resistance means (17) is provided for legs lever (16).

A flexible universal joint (18) is attached to each arm lever (15) at a spaced position.

A flexible universal joint (18) is attached to legs lever (16) at a spaced position.

Resistance means (17) is attached to the flexible universal joint (18) of each arm lever (15).

Resistance means (17) is attached to the flexible universal joint (18) of legs lever (16).

A connection means (19) is attached to upper body support (12)

A flexible universal joint (18) attached to the right side of the connection means (19).

A flexible universal joint (18) attached to the left side of the connection means (19).

A flexible universal joint (18) attached to the base means (11) at a spaced distance below the lower body support (13)

Resistance means (17) is attached to the flexible universal joint (18) on the right side of the connection means (19).

Resistance means (17) is attached to the flexible universal joint (18) on the left side of the connection means (19).

Resistance means (17) is attached to the flexible universal joint (18) at the base means (11).

The length of the arm levers is telescopically adjustable.

The length of the legs lever is telescopically adjustable.

Resistance means (17) in the preferred embodiment are hydraulic cylinders.

Resistance means (17) may consist springs, pneumatic cylinders, rubber bands, friction balls, weights or any other means that can provide the desired resistance.

I claim:

1. An exercise and training apparatus comprising:

a base frame member for supporting the apparatus on a supporting surface;

a lower body support member secured to a top portion of the base frame member extending along a longitudinal axis of said base frame member, said lower body support member having a front end and a back end, and a right side and a left side;

a first connection means attached to said base frame proximate said first end of said lower body support member;

a single legs lever pivotally attached to said connection means, and adapted to receive both legs of a user in unison to move said single legs lever in a plurality of planes;

a first resistance means having a first end connected to the base frame member and a second end connected to the single legs lever;

an upper body support member proximate the back end of said lower body support member pivotally secured to said base frame member allowing said upper body support member to be set at several angles with respect to the base frame member in order to accommodate several body positions from upright sitting position to flat horizontal prone position extending along the longitudinal axis of said base frame member;

a second connection means attached to a left side of the upper body support member proximate to an upper end of said upper body support member and a left arm lever attached to said second connection means adapted to engage a user's left arm to move said left arm lever in a plurality of planes;

a second resistance means having a first end connected to the base frame member and a second end connected to the left arm lever;

a third connection means attached to a right side of the upper body support member proximate to an upper end of said upper body support member and a right arm lever attached to said second connection means adapted to engage a user's right arm to move said right arm lever in a plurality of planes; and a third resistance means having a first end connected to the base frame member and a second end connected to the right arm lever.

2. The exercise and training apparatus according to claim 1, wherein;

the resistance means is selected from the group consisting of: hydraulic cylinders, springs, pneumatic cylinders, weights, and rubber bands.

3. The exercise and training apparatus according to claim 2, wherein;

the single legs lever includes means to receive a user's feet in order to allow a user to move said single legs lever in a plurality of planes.

4. The exercise and training apparatus according to claim 2, wherein;

said single legs lever is telescopically adjustable in order to fit the user's legs.

5. The exercise and training apparatus according to claim 2, wherein;

said left arm lever and right arm lever are telescopically adjustable in order to fit the user's left and right arms.

* * * * *